United States Patent [19]

Aradi et al.

[11] 4,203,228

[45] May 20, 1980

[54] CONTACTING AND DRYING OF MATERIAL IN A SPOUTED SYSTEM

[75] Inventors: Emil Aradi; Tibor Blickle; Endre Monostori; Jenö Németh; Ivanne Pallai, all of Budapest; János Varga, Mosonmagyaróvár, all of Hungary

[73] Assignees: MTA Müszaki Kémiai Kutató Intézet, Veszprem; Keszthelyi Agrártudományi Egyetem, Keszthely, both of Hungary

[21] Appl. No.: 919,300

[22] Filed: Jun. 26, 1978

[51] Int. Cl.[2] ..... F26B 3/08; F26B 7/00

[52] U.S. Cl. ..... 34/10; 34/12; 34/57 A; 34/60

[58] Field of Search ..... 34/10, 12, 57 A, 60, 34/61

[56] References Cited

U.S. PATENT DOCUMENTS

| | | | |
|---|---|---|---|
| 2,207,360 | 7/1940 | Spellacy | 34/60 X |
| 2,786,280 | 3/1957 | Gishler et al. | 34/10 |
| 3,913,238 | 10/1975 | Updegrove | 34/12 |
| 4,030,205 | 6/1977 | Robertson et al. | 34/60 |

*Primary Examiner*—John J. Camby

*Attorney, Agent, or Firm*—Ernest F. Marmorek

[57] ABSTRACT

An apparatus and a method for at least partially drying a first substantially granular material inclusive of a fluid, and mixing the first material with a second substantially granular material, includes a container, a conveyor disposed in the container, and an air supply for blowing air into the mixed first and second materials. The materials then become at least partially loosened, are dried by the air blown thereinto, are moved operatively at least partially upwards by the conveyor, and are then allowed to drop downwards within the container.

17 Claims, 1 Drawing Figure

CONTACTING AND DRYING OF MATERIAL IN A SPOUTED SYSTEM

BACKGROUND OF THE INVENTION

Many fluid processes are known for mixing material with gases. These include also versions employing jet streams, such as, for example, the method of employing a jet stream ejected from a nozzle (U.S. Pat. Nos. 2,786,280, and 2,786,281). In this process, there is supplied pressurized air to a granular material disposed in a container through a nozzle pointing in a vertical direction, the jet stream opening up a channel in an axial direction of the granular material layer. This channel behaves operatively as a pneumatic conveyor, through which the jet stream ejected from the nozzle conveys a portion of the material in an upwardly direction. The granular material arriving in this fashion at the surface of the material layer then slides downwardly along the walls of the container, is then returned to the vicinity of the nozzle, and thus participates in a continuous jet-like movement of the material.

In the interest of a reliable implementation of the channel being formed along the axis of the material layer, it is known to often use a tube at this location, to aid in the formation of the channel, which tube cooperates with the nozzle arranged therebelow in a way similar to an injector, and participates in the transport of the material as a conveying tube, using a dense supply stream. (Scientific results of the technical-chemical Research Institute of the Hungarian Academy of Sciences III Veszprém, 1975, p. 173.)

The container of an apparatus forming a jet stream may be implemented in different versions, either according to the above-described patent, or according to other references or sources; the supply of raw materials to the system, and the discharge of the materials can be accomplished by different methods and at different locations (Dr. L. Imre, Handbook Relating to Drying, paragraphs 15.2.3). There is also known the series-and parallel-switching of a plurality of devices used in jet streams. (Hungarian Pat. No. 160,333.1).

A common disadvantage of the above-described arrangement is the fact that the dimensions, and consequently also the efficiency or output of devices of the above-described kind provided with nozzles is limited, and that therefore the energy requirement or demand of the air blower is high, in view of the high pressure required for setting in motion the needed jet stream. In known devices employing jet streams, the operative pressure of the compressed air, or of the drying medium, is greater than the hydrostatic pressure of the material layer subjected to the jet treatment. A further important factor, which limits the applicability of the method of applying the jet stream, is the fact that in a device using nozzles of the aforesaid type, whether they are used in conjunction with the tube or without the tube, only materials having grains of limited size can be processed, and of these only those which have suitable properties, to ensure that the grains of the material may roll with respect to one another. In the case of angular or cornered grains, adhering relatively strongly to one another, a continuous jet movement cannot take place, but instead there occur discontinuous impacts, formation of craters in the material, a generation of a subsidiary jet system, or swelling of the grains.

To obviate the disadvantageous properties of the jet stream method, namely, the limited dimensions of the device, the relatively large energy requirement for ventilation, the failure to realize a jet movement in the event of materials not complying with the requirement for grains to be capable of rolling with respect to one another, and the required maximum dimensions of the grains, there has been used an apparatus employing jet streams, making use of a plurality of nozzles, so that both the dimensions and the output of the device could be increased to a considerable measure. (Palaine, Nemeth, Raticz, Ratkai: New Construction for Jet-Like Devices, 2d. edition of the Conference of Construction of Chemical Machines, Budapest, January, 1975). The treatment by means of a jet stream of grains not meeting the grain rolling requirements, and the prescribed or limiting dimensions of the grains cannot, however, be administered to such grains by this means, and neither can the energy requirement for ventilation be produced thereby. The latter objectives can be obtained by a method employing jets implemented by an auxiliary air stream, where a portion of the fluid or gas is introduced, not by means of a nozzle, but through a gas-permeable floor disposed below the materials to be dried. The required gas pressure is, however, very considerable, also in this case.

SUMMARY OF THE INVENTION

It is therefore one of the principal objects of the invention to develop a jet stream which, unlike systems of the prior art, permits an arbitrary increase of its dimensions, which has a relatively low energy requirement for ventilation, and which is also suitable for treating adhesive goods or materials by the jet-method which do not meet the grain rolling requirements of the prior art, and which also have grain sizes within wide tolerances.

The invention is based on the realization that the required objective can be obtained by means of an apparatus for at least partially drying a first material selected from the group consisting of granular material, powdered material, material in solution, material in suspension, paste-like material, and a fluid, and for mixing the first material with a second material selected from the group consisting of granular material, powdered material, material in solution, material in suspension, and paste-like material which includes, in combination, a container, a longitudinal conveyor having its direction of elongation arranged substantially vertically, and which is disposed in the container, and air supply means for blowing air into the mixed first and second materials. The mixed materials may then be partially loosened and dried by the air blown thereinto, and may be operatively moved at least partially in an upward direction by the conveyor, and are permitted, upon completion of the upward motion to move downwards within the container.

It is preferable if the apparatus further includes a tube which has a direction of elongation arranged substantially vertically and is disposed in a container, and if the conveyor is at least partially disposed in the tube.

It is further advantageous if the air supply means includes a perforated floor, so that outside air may be passed through the perforated floor, and there is additionally included a mixer disposed within the container for mixing materials.

The mixer has preferably a plurality of sides, and includes an axis arranged substantially vertically; in one version of the present invention, the air supply means is arranged on one side of the container.

It is further preferable if the materials reach a predetermined level in the container, and if the conveyor is disposed below that predetermined level.

The apparatus includes driving means operatively connected to the conveyor for driving the conveyor. The driving means preferably include a gear train. It is also advantageous if the driving means are operatively connected to the mixer.

In one version of the invention, the conveyor is a screw conveyor.

It is advantageous if the air supply means includes a plurality of rotatable blades for operatively imparting a spin to the air.

The method, according to the present invention, therefore includes the steps of at least partially drying a first material selected from the group consisting of granular material, powdered material, material in solution, material in suspension, paste-like material, and a fluid, and for mixing the first material with a second material selected from the group consisting of granular material, powdered material, material in solution, material in suspension, and paste-like material in a container containing a longitudinal conveyor having a direction of elongation arranged substantially vertically, and being disposed in the container, and air supply means; blowing air into the mixed first and second materials at a ratio not exceeding 50 kp of materials per kp of air; and operatively moving the materials at least partially in an upward direction by the conveyor, so that the materials are allowed to move downwards on completing their upward motion.

It is preferable if the conveyor is a screw conveyor, and the steps include the step of operatively moving the materials by the screw conveyor helicoidally.

The method advantageously includes the step of operatively moving the materials by a mixer.

It is additionally advantageous if the apparatus includes an elongated tube, having its direction of elongation arranged substantially vertically, which tube is disposed in the container, and wherein the conveyor is at least partially disposed in the tube; the steps then include operatively moving the materials at least partially in an upward direction within the tube. It is advantageous if the steps further include imparting a spinning motion to the air blown into the materials; the container may also have a side, and a further step may include the blowing of air into the materials through the side of the container.

The container is advantageously formed with a perforated floor, and the steps then include the step of blowing air into the materials through the perforated floor. In an alternate version of the invention, there is further included the step of blowing air into the materials at a ratio not exceeding 30 kp of materials per kp of air through the side, and imparting a spinning motion to the air blown into the materials.

BRIEF DESCRIPTION OF THE DRAWING

For a fuller understanding of the nature and objects of the invention, reference should be had to the following detailed description, taken in connection with the accompanying drawing, in which the sole FIGURE of the drawing is an elevated view of the apparatus, according to the present invention, in partial cross-section.

DESCRIPTION OF THE PREFERRED EMBODIMENT

Figure 1:
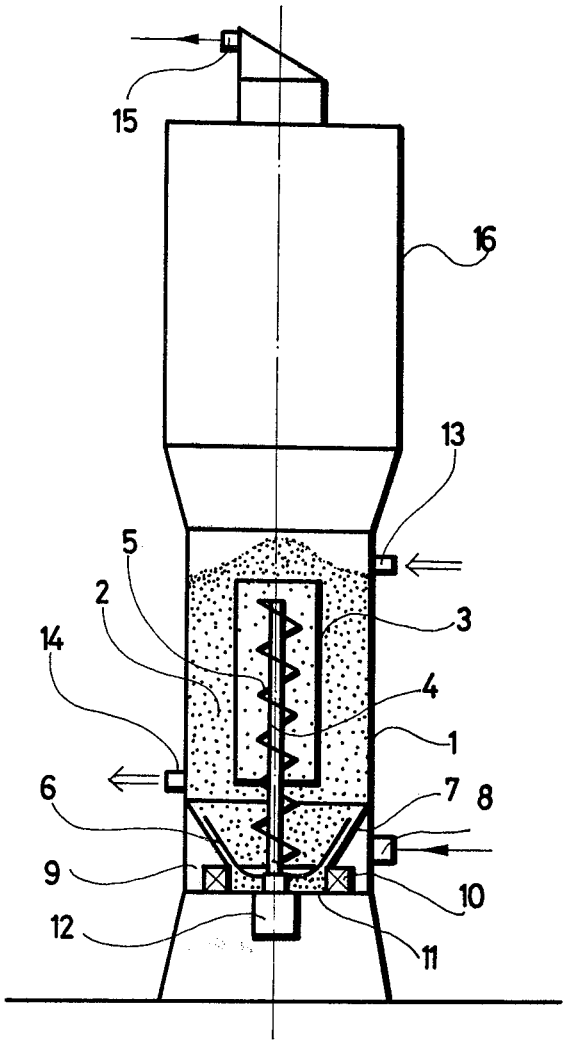

In carrying the invention into effect, it will be seen that there is disposed in a container 1 a granular material 2, a vertically disposed tube 3, a screw-type conveyor 5, rotatable around a shaft 4, and a mixer 6 disposed below the tube 3, and also rotatable about the shaft 4. A cover 7, in the shape of an inverted cone, closes the container 1 on the bottom, and prevents the flow of the granular material 2 within the container 1 through the bottom. Air may be supplied to the container 1 either through air supply means 8 arranged on one side of the mixer 6, or through a perforated bottom plate 11, arranged at a lower end of the truncated cone 7. A recess 9 is defined between the truncated cone 7 and the container 1, the air in recess 9 passing through a plurality of rotatable blades 10 and the perforated truncated cone 7 to the granular material 2, in the event the lateral air supply means 8 is used. The shaft 4 is driven through a gear train 12, disposed below the floor 11. Air blown through the container 1 is allowed to pass into an elongated tube 16 having a diameter exceeding the diameter of the container 1, and is discharged therefrom through exhaust means 15. Alternately, the air may be discharged through exhaust means 14, disposed at one side of the container 1.

Operation

The operation of the apparatus, according to the present invention, will be illustrated by means of several examples.

EXAMPLE 1

The granular material 2, including grains of arbitrary shape, is loosened by means of the mixer 6, and the air supply entering the material; the grains are moved in a substantially helicoidal fashion upwards as a result of the air stream, as well as the movement of the conveyor 5, being guided within the tube 3. Moving upwards within the tube 4, the material is eventually discharged from the container 3 at the upper end thereof, and is then permitted to move downwardly along the walls of the container 1.

EXAMPLE 2

This example illustrates the operation of the apparatus, according to the present invention, and the method, according to the present invention, in describing the drying process of paprika used as a spice, which has been precrushed in a hammermill.

As is known, crushed paprika, employed as a spice, belongs to a class of milling goods which has adhesive properties not suitable for a rolling motion, which has a medium corn size between 1 to 2 millimeters, and a humidity between 12 to 16 percent, which must be reduced to a range between 4 to 6 percent. This results in an approximate doubling of the output of paprika mills.

When crushed paprika of the aforesaid kind is fed to jet devices having nozzles, no jet motion results, irrespective of whether a truncated, cone-shaped floor, tube, or an auxiliary air supply is used. The compressed air creates a funnel within the goods, but the goods are not conveyed therethrough, as the grains disposed in the lower half of the device are unable to move from an outer ring to the vicinity of the jets.

In the apparatus, according to the present invention, the tube 3 and the mixer 6 are then used. The mixer 6 is disposed above the floor 11 of the container 1, and operates at a relatively high number of revolutions, and at a peripheral velocity of at least 4 meters per second. Drying air is supplied in the vicinity of the floor 11 laterally of the mixer 6 by the plurality of rotating blades 10, the air being fed to the goods 2 tangentially. The lower part of the material layer is loosened by the air stream, and the spin of the mixer 6, so that the air takes the grains of the goods along and into the tube 3, there developing an undisturbed helicoidal motion of the paprika layer 2. A motion of this type is obtained also, and independently of the operation of the mixer 6, due to the pressure required to result in a pneumatic conveyance of the materials along the length of the tube 3 being smaller than the pressure required to slidingly push the goods through the tube 3 in a manner similar to non-turbulent fluid flow. In addition to the method described above, the shape of the mixer 6 may influence not only the loosening of the lower layer of the granular goods, but may assist in the formation of a jet stream itself. By an appropriate choice of the diameter of the tube 3, the gas or fluid introduced into the device, according to the present invention, per unit time, can be increased in a large measure. In the case of the aforedescribed paprika, the air velocity used in the container was increased from a conventional value of 0.25 meters per second, used in devices of the prior art, to a value of about 1.5 meters per second. Furthermore, the reduction in pressure of the drying air amounts to only about one-half the hydrostatic pressure of the material layer to be dried.

EXAMPLE 3

This example relates to the drying of feed corn, in the apparatus according to the present invention.

In the case of drying of feed corn, an evaporation of 1,000 to 5,000 kilograms of water per hour is desirable. No attempt has ever been made to operatively employ or try out an apparatus using a jet stream and employing nozzles, so as to to attain this desired goal, because of the difficulties resulting in the construction of such a system due to the necessity of enlarging its dimensions.

In the present example, a jet motion of the feed corn is accomplished by means of the screw conveyor 5; it is the task of the warm air supplied to dry the material at the lowest possible pressure loss. In an apparatus of this type, good results have been realized using a peripheral velocity in the range of 0.5 to 2.0 meters per second of the worm gear 5, its diameter having been one quarter of the diameter of the apparatus, according to the present invention.

By means of this apparatus, it is possible, when using a suitable drying temperature, to achieve a specific evaporation of water within the range of 500 to 800 kilograms per square meter per hour, when drying feed corn. Thus, a favorable use of heat energy when drying by means of a jet stream can be made use of, which is below 100 kcal per kg of water, even when drying feed corn which poses relatively large energy demands.

EXAMPLE 4

Drying of relatively large-sized corn grains poses difficulties, for example, when employing a jet method for drying in conventional jet-type devices, in view of the pressure conditions prevailing therein, and in view of the limits which have been set for dimensioning such conventional devices. An example is the drying of vegetable cubes by means of the jet stream method.

Vegetable cubes made of carrots, beets, celery, apple cubes and the like, can be dried, according to Example 3, when utilizing the screw conveyor 5. In this case, specific water evaporation corresponds to the conditions enumerated in Example 3.

Drying of the goods which have been crushed and compacted into a cube, can be accomplished according to the present example, by using the tube 3. The rotatable blades 10 feed the drying medium, imparting a spin thereto, below the material layer 2, which layer has been cut up into cubes. Thus, the lower portion of the material of the layer 2 is loosened, and the grains roll from the sliding layer in the vicinity of the container wall 1 unhindered into the tube 3. In tube 3, there arises a relatively thin mixing ratio in comparision to known jet-stream devices of $\mu$ being equal between 10 to 30 kp material per/kp of air, and the pressure loss of the drying medium used is smaller than half the hydrostatic pressure of the layer to be dried.

The main advantage of the apparatus, according to the present invention, and of the inventive method, can be summarized in that the advantageous and economical jet stream method can also be used for treating materials hitherto unsuitable for being treated by the jet stream.

We wish it to be understood that we do not desire to be limited to the exact details of construction shown and described, for obvious modifications will occur to a person skilled in the art.

Having thus described the invention, what we claim as new and desire to be secured by Letters Patent, is as follows:

1. An apparatus for at least partially drying a first material selected from the group consisting of granular material, powdered material, material in solution, material in suspension, paste-like material, and a fluid, and for mixing said first material with a second material selected from the group consisting of granular material, powdered material, material in solution, material in suspension, and paste-like material, comprising in combination:

a container, a longitudinal conveyor having its direction of elongation arranged substantially vertically, and being disposed in said container, a tube having its direction of elongation arranged substantially vertically and being disposed in said container, said conveyor being at least partially disposed in said tube, and air supply means for blowing air at least in part upwardly through said tube into the mixed first and second materials, said mixed materials being at least partially loosenable and dryable by the at least partially upwardly moving air blown thereinto, and being operatively movable at least partially in an upward direction by said conveyor, and upon completion of the upwards motion being movable downwards within said container.

2. An apparatus according to claim 1, wherein said air supply means includes a perforated floor, outside air being passable through said floor, and further comprising a mixer disposed within said container for mixing said materials.

3. An apparatus according to claim 2, wherein said mixer has a plurality of sides, and includes an axis arranged substantially vertically, said air supply means being arranged on one side of said mixer.

4. An apparatus according to claim 1, wherein said materials reach a predetermined level in said container, said conveyor being disposed below said predetermined level.

5. An apparatus according to claim 1, further comprising driving means operatively connected to said screw conveyor for the driving thereof.

6. An apparatus according to claim 5, wherein said driving means includes a gear train.

7. An apparatus according to claim 2, further comprising driving means operatively connected to said conveyor and to said mixer.

8. An apparatus according to claim 1, wherein said conveyor includes a screw conveyor.

9. An apparatus according to claim 1, wherein said air supply means includes a plurality of rotatable blades for operatively imparting a spin to the air.

10. An apparatus according to claim 1, wherein said air supply means is disposed near one side of said container, whereby a rotary motion is imparted to the air entering said container.

11. A method of at least partially drying a first material with the aid of a container including a longitudinal conveyor having its direction of elongation arranged substantially vertically, and being disposed in the container, air supply means, an elongated tube having its direction of elongation arranged substantially vertically and being disposed in said container, said conveyor being at least partially disposed in said tube, said first material being selected from the group consisting of granular material, powdered material, material in solution, material in suspension, paste-like material and a fluid, and for mixing said first material with a second material selected from the group consisting of granular material, powdered material, material in solution, material in suspension, and paste-like material in said container, comprising the steps of:

blowing air into the mixed first and second materials at a ratio not exceeding 50 kp of materials per kp of air, and operatively moving said materials at least partially in an upward direction by the conveyor, and at least partially in said tube, whereby the materials move downwards upon completing their upward motion.

12. A method according to claim 11, wherein said conveyor includes a screw conveyor, and further comprising the step of operatively moving said materials by said screw conveyor helicoidally.

13. A method according to claim 11, wherein said conveyor includes a mixer, and further comprising the step of operatively moving said materials by said mixer.

14. A method according to claim 11, further comprising the step of imparting a spinning motion to the air blown into the materials.

15. A method according to claim 14, wherein said container has a side, and further comprising the step of blowing air into said materials through the side of said container.

16. A method according to claim 14, wherein said container has a perforated floor, and further comprising the step of blowing air into said materials through said perforated floor.

17. A method according to claim 11, wherein said container has a side, and further comprising the steps of blowing air into said materials at a ratio not exceeding 30 kp of materials per kp of air through said side, and imparting a spinning motion to the air blown into said materials.

* * * * *